US005777650A

United States Patent [19]

Blank

[11] Patent Number: 5,777,650

[45] Date of Patent: Jul. 7, 1998

[54] PRESSURE ROLLER

[75] Inventor: Jeffrey K. Blank, Tigard, Oreg.

[73] Assignee: Tektronix, Inc., Wilsonville, Oreg.

[21] Appl. No.: 744,803

[22] Filed: Nov. 6, 1996

[51] Int. Cl.[6] ..... B41J 2/01; B41J 2/05

[52] U.S. Cl. ..... 347/103; 492/56

[58] Field of Search ..... 347/103, 101; 355/285; 492/23, 24, 28, 32, 56; 399/339

[56] References Cited

U.S. PATENT DOCUMENTS

| | | | |
|---|---|---|---|
| 4,124,572 | 11/1978 | Mao | 528/76 |
| 5,092,235 | 3/1992 | Rise | 100/168 |
| 5,195,430 | 3/1993 | Rise | 100/524 |
| 5,243,393 | 9/1993 | Menjo | 355/284 |
| 5,257,967 | 11/1993 | Gysin | 492/56 |
| 5,372,852 | 12/1994 | Titterington et al. | 427/288 |
| 5,389,958 | 2/1995 | Bui et al. | 347/103 |
| 5,450,183 | 9/1995 | O'Leary | 355/285 |
| 5,502,476 | 3/1996 | Neal et al. | 347/103 |

FOREIGN PATENT DOCUMENTS

| | | | |
|---|---|---|---|
| 0712794 | 7/1996 | Canada . | |
| 0231578 | 10/1986 | Japan | G03G 15/20 |

*Primary Examiner*—Benjamin R. Fuller
*Assistant Examiner*—Juanita Stephens
*Attorney, Agent, or Firm*—Charles F. Moore

[57] ABSTRACT

A roller for applying pressure to a final receiving medium to transfer and fix an ink image thereon is provided. The roller includes a core surrounded by an inner elastomeric layer. A tubular elastomeric sleeve having a first, relatively high hardness surrounds the inner elastomeric layer. A thin outer compliant elastomeric layer is affixed to the outer surface of the sleeve and has a second hardness that is less than the first hardness of the sleeve. The outer compliant elastomeric layer of the roller has sufficient compliance to contact adjacent ink pixels having first and second heights and fix the ink pixels to the final receiving medium.

24 Claims, 2 Drawing Sheets

PRESSURE ROLLER

FIELD OF THE INVENTION

The present invention relates generally to a roller for fixing an ink image on a receiving medium and, more particularly, to a multi-layer pressure roller that creates a narrow, high pressure nip and includes an outer compliant elastomeric layer that provides improved ink image fixation on the receiving medium with reduced thermal requirements.

BACKGROUND OF THE INVENTION

Ink-jet printing systems commonly utilize either direct printing or offset printing architecture. In a typical direct printing system, ink is jetted from nozzles in the print head directly onto the final receiving medium. In an offset printing system, the print head nozzles jet the ink onto an intermediate transfer surface, such as a liquid layer on a drum. The final receiving medium is then brought into contact with the intermediate transfer surface and the ink image is transferred and fixed (transfixed) to the medium.

In direct and offset printing systems that utilize phase change ink, it is common to fix the ink image on the final receiving medium by passing the medium through a pressurized nip defined by a pair of rollers. The rollers are biased together to create the nip by spring loading the outer ends of at least one of the rollers in a direction normal to the longitudinal axis of the roller. To maximize the nip pressure, the outer layer of one or both of the rollers is typically made from a rigid material having a high durometer or hardness.

To produce a high quality image, it is necessary for the rollers to create a nip that applies substantially uniform pressure across the length of the nip. In some ink-jet printing applications, such as phase change color ink-jet systems using subtractive color mixing techniques, both single and multiple layers of ink pixels are applied to the final receiving medium. This results in surface areas of the medium having different thicknesses of ink, such as where a single ink pixel is adjacent to multiple layers of ink pixels. To achieve high image quality, the rollers must apply uniform pressure to the areas of the medium containing both single and multiple layers of ink pixels, notwithstanding their different thicknesses or heights. Accordingly, in addition to being sufficiently rigid to create the high pressure nip, it is also desirable for the roller to have a measure of compliance to conform to various ink thickness on the final receiving medium.

A roller with insufficient compliance produces a non-uniform nip pressure that promotes media wrinkling and incomplete image transfer and/or fixation on the media. To compensate for lower or insufficient roller compliance, many prior art phase change ink-jet printing systems utilize preheated media and/or elevated ink temperatures to facilitate image transfer and fixation. However, as the temperatures of the ink and the media increase, so do their coefficients of friction. This, in turn, promotes media wrinkling and reduced image quality. Additionally, the higher temperatures and coefficients of friction also make duplexing impractical, as the duplexed image is likely to smear. This occurs when the elevated preheat temperatures soften the ink in the first printed image and thereby make it more susceptible to smearing as the medium passes through the pressurized nip for the second time.

With specific regard to offset printing applications, non-uniform nip pressure results in diminished image transfer capability as well as media wrinkling. Image transfer relates to the percentage of ink droplets that are transferred from the intermediate transfer surface to the final receiving medium during the transfer printing process. For optimal image transfer, the outer layer of the transfer roller must be sufficiently compliant to conform to the different thicknesses of the single-and multiple-layers of ink pixels.

An exemplary patent directed to an offset ink-jet printer is U.S. Pat. No. 5,502,476, for METHOD AND APPARATUS FOR CONTROLLING PHASE-CHANGE INK TEMPERATURE DURING A TRANSFER PRINTING PROCESS, assigned to the assignee of the present application. This patent teaches the use of a pressure roller having a metallic core and a single elastomeric covering. The elastomeric covering engages the final receiving medium on the side opposite to the side that contacts the intermediate transfer surface to transfix the ink image to the final receiving medium. The nip in the '476 printer is created between the roller and a drum that supports the intermediate transfer surface, with the nip pressure being in the range between 500 and 600 pounds per square inch (psi)(between 3,447 and 4,137 kPa).

Prior to transfixing the ink image, the '476 printer preheats the final receiving medium and the ink on the intermediate transfer surface. To provide acceptable image transfer and final image quality, the '476 printer utilizes relatively high medium preheat temperatures in the range of about 85° C. to about 105° C. These media temperatures are in the region that softens the ink and preclude duplex printing.

With regard to direct printing applications, one prior art patent directed to improving nip pressure uniformity is U.S. Pat. No. 5,092,235 for a PRESSURE FIXING AND DEVELOPING APPARATUS, also assigned to the assignee of the present application. This patent discloses dual pressure rollers that each utilize a contoured core to control the pressure distribution across the nip. One of the rollers includes a rigid, non-compliant external shell that provides a hard surface against which the ink coated surface of the final receiving medium passes within the nip. The other roller includes a more compliant shell, such as nylon, covering an elastomeric material that is affixed to the core. The nylon shell allows the roller to more effectively treat paper containing different thicknesses of ink. The '235 roller, however, still lacks the necessary compliance for effective image transfer in an offset printing system.

While the prior art pressure rollers have proven generally adequate for their intended purposes, a need remains for an improved pressure roller that combines rigidity on a macro level for high nip pressure along the entire nip with compliance on a micro/pixel-to-pixel level for improved transfer and/or fixing of ink pixel layers having different heights. The roller should be capable of generating a high nip pressure without requiring excessive end loads. It is also desirable that the roller exhibit the above characteristics while operating with lower medium and ink preheat temperatures to reduce media wrinkling and allow duplexing capability.

SUMMARY OF THE INVENTION

It is an aspect of the present invention to provide a pressure roller for fixing an ink image on a receiving medium.

It is another aspect of the present invention to provide a pressure roller that creates a substantially uniform nip pressure across a final receiving medium having single and multiple layers of ink pixels.

It is a feature of the present invention that the pressure roller exhibits rigidity on a macro level to create high nip pressure along the entire nip.

It is another feature of the present invention that the pressure roller also exhibits compliance on a micro/pixel-to-pixel level for improved ink image transfer and/or fixation.

It is yet another feature of the present invention that the pressure roller creates a narrow and high pressure nip without requiring excessive end loads.

It is still another feature of the present invention that the pressure roller utilizes three layers of urethane for improved layer-to-layer bonding and greater fatigue resistance.

It is an advantage of the present invention that the pressure roller provides compliance across the exposed surface area of adjacent pixels for improved image transfer in an offset printing architecture.

It is an advantage of the present invention that the pressure roller allows for lower media and ink preheat temperatures to reduce media wrinkling and allow for duplex printing capability.

To achieve the foregoing and other aspects, features and advantages, and in accordance with the purposes of the present invention as described herein, an improved pressure roller for transferring and/or fixing an ink image on a receiving medium is provided. The pressure roller combines wide-scale rigidity for a high pressure nip with localized compliance for complete ink image transfer and/or fixation on the receiving medium. The high pressure nip and the improved compliance allow for lower media and ink preheat temperatures to reduce media wrinkling and to permit duplex printing. The roller also utilizes a multi-layered construction that creates the high nip pressure without requiring excessive end loads.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

FIG. 1 is a diagrammatic illustration of an offset ink-jet printing apparatus that utilizes the pressure roller of the present invention, the roller being biased toward a supporting surface to form a nip there between.

Reference will now be made in detail to the present preferred embodiment of the invention, an example of which is illustrated in the accompanying drawings.

DETAILED DESCRIPTION OF THE PREFERRED EMBODIMENT

Figure 1:
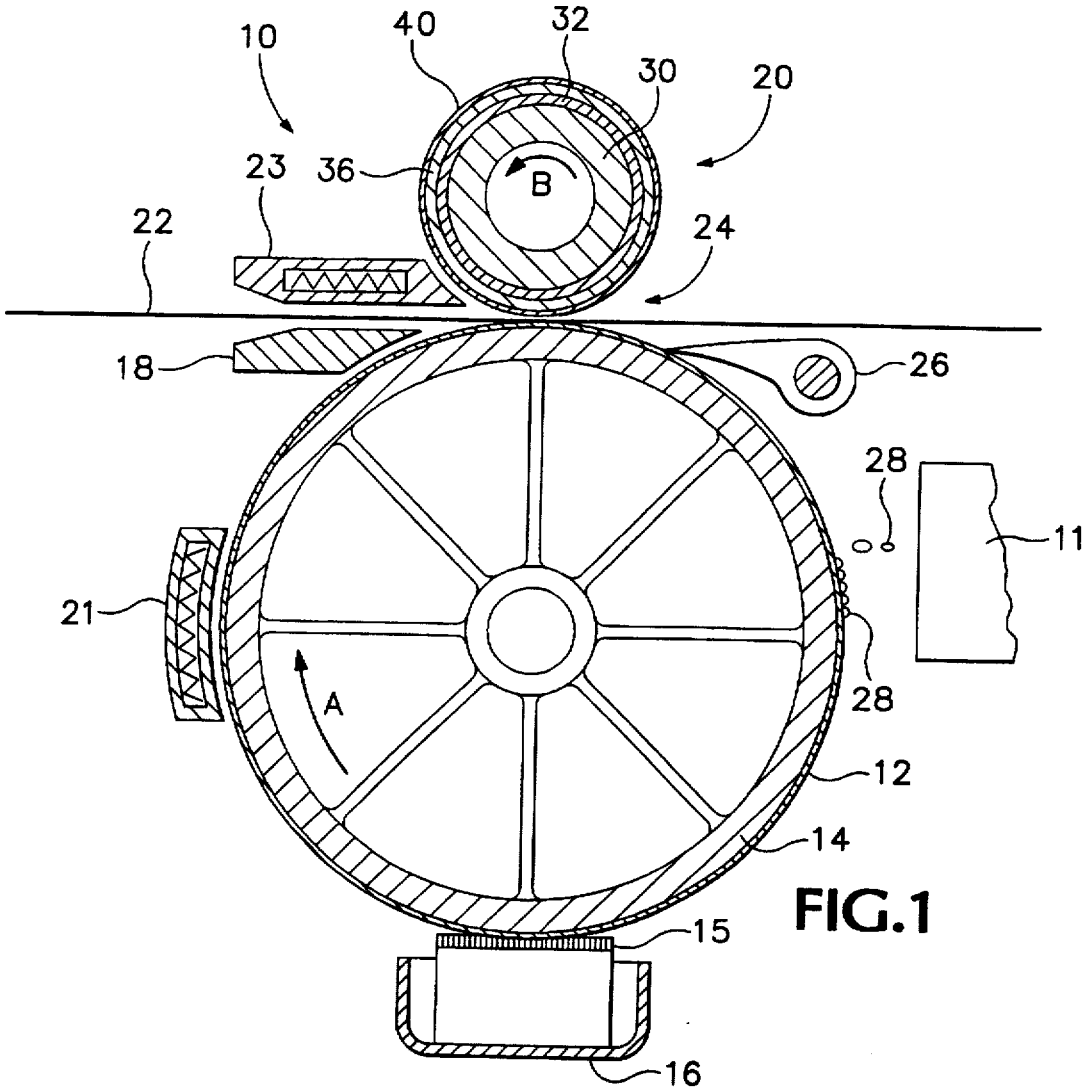

FIG. 1 is an illustration of an offset ink-jet printing apparatus 10 that utilizes the pressure roller 20 of the present invention. An example of this type of printing apparatus is disclosed in U.S. Pat. No. 5,389,958 entitled IMAGING PROCESS and assigned to the assignee of the present application. The '958 patent is hereby specifically incorporated by reference in pertinent part. The following description of a preferred embodiment of the roller of the present invention refers to its use in this type of printing apparatus. It will be appreciated, however, that the roller of the present invention may be used with various other printing apparatus that utilize different imaging technologies and/or architectures, such as laser imaging in which multiple layers of toner must be fixed to a receiving medium. Accordingly, the following description will be regarded as merely illustrative of one embodiment of the present invention.

With continued reference to FIG. 1, a print head 11 is supported by an appropriate housing and support elements (not shown) for either stationary or moving utilization to place ink drops 28 in the liquid or molten state on an intermediate transfer surface 12. The intermediate transfer surface 12 is a liquid layer that is applied to a supporting surface 14, such as a belt, drum, web, platen, or other suitable design. The intermediate transfer surface 12 is applied by contacting the supporting surface 14 with an applicator, such as a metering blade, roller, web, or a wicking pad 15 contained within an applicator assembly 16.

Supporting surface 14 (hereafter "drum 14") may be formed from or surface coated with any appropriate material, such as metals including but not limited to aluminum, nickel, or iron phosphate, elastomers including but not limited to fluoroelastomers, perfluoroelastomers, silicone rubber, and polybutadiene, plastics including but not limited to polyphenylene sulfide loaded with polytetrafluorethylene, thermoplastics such as polyethylene, nylon, and FEP, thermosets such as acetals, and ceramics. The preferred material is anodized aluminum.

A media guide 18 passes a final receiving medium 22, such as paper or a transparency, from a positive feed device (not shown) past a media preheater 23 and into a nip 24. The nip 24 is formed by urging together the opposing arcuate surfaces of the pressure roller 20 of the present invention, described in more detail below, and the intermediate transfer surface 12 supported by drum 14. The drum 14 and pressure roller 20 are shown rotating in the direction of action arrows A and B, respectively, to pass the medium 22 through the nip 24. Typically, the drum 14 is positively driven while the pressure roller 20 is driven by being in surface contact with the drum. Of course, the drum 14 and pressure roller 20 may be geared or otherwise coupled together for driving purposes or separately driven if desired. After the medium 22 passes through the nip 24, stripper fingers 26 (only one of which is shown) may be pivotally mounted to the printing apparatus 10 to assist in removing medium 22 from the intermediate transfer surface 12.

The drum 14 and pressure roller 20 are urged together at their respective ends by a biaser 60. An example of a suitable biaser is the spring mechanism disclosed in U.S. Pat. No. 5,092,235, entitled PRESSURE FIXING AND DEVELOPING APPARATUS and assigned to the assignee of the present application. The '235 patent is hereby specifically incorporated by reference in pertinent part. It will be appreciated that other suitable biasers may be used including, but not limited to, solenoids, motors and pneumatic and hydraulic cylinders.

The ink utilized in the printing apparatus 10 is preferably initially in solid form and is then changed to a molten state by the application of heat energy to raise its temperature to within a range of between about 85° C. to about 150° C. The molten ink drops 28 are then ejected from ink jets (not shown) in print head 11 to the intermediate transfer surface 12, where they are cooled to an intermediate temperature and solidify to a malleable state. The intermediate temperature wherein the ink is maintained in the malleable state is between about 40° C. to about 60° C., and preferably about 50° C. To maintain the ink at the desired intermediate temperature, a drum heater 21 may be utilized. After they are deposited on the intermediate transfer surface 12, the ink drops 28 are then transfixed to the final receiving medium 22 by passing the medium through the pressurized nip 24 between the roller 20 and the intermediate transfer surface 12 on drum 14. Prior to entering the nip 24, the medium 22 is preheated by the preheater 23 to a temperature within a range of about 55° C. to about 75° C., and preferably to about 63° C.

Figure 2:
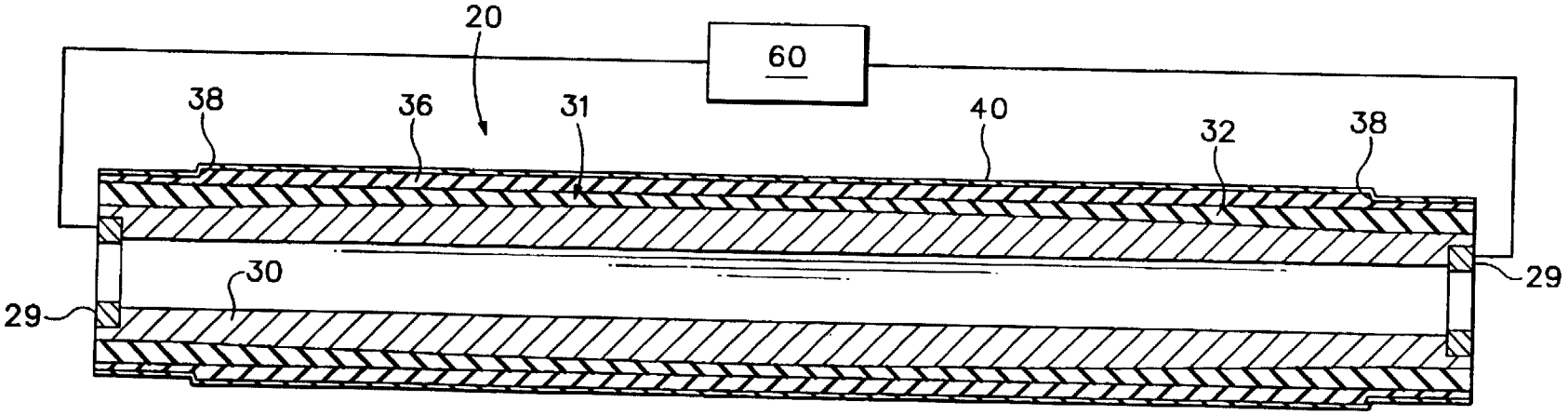
FIG. 2 is a side elevational view in cross section of the pressure roller of the present invention.
Figure 3:
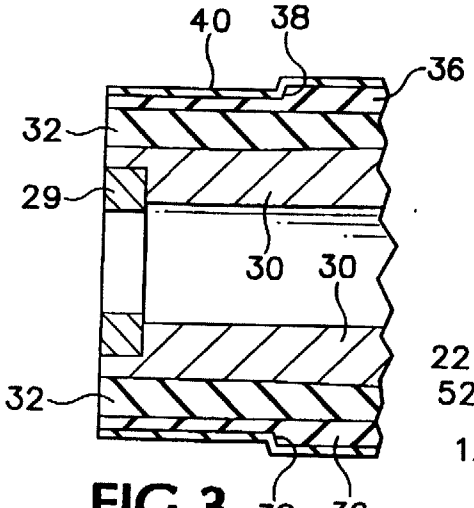
FIG. 3 is an enlarged partial side view in cross section showing the core of the roller and the multiple elastomeric layers surrounding the core.

Reference will now be made in detail to a preferred embodiment of the roller 20 of the present invention. As shown in FIGS. 2 and 3, the roller 20 rotates about two ball bearings 29, one at each end of the roller. The bearings 29 are seated in an elongated core 30. Preferably, the core 30 is made from a rigid, non-compliant material, such as cold drawn steel. The core 30 may be solid or hollow and may have various shapes and cross-sectional dimensions. In the preferred embodiment, the core 30 is a hollow cylinder with a generally increasing transverse cross-sectional dimension from the respective ends of the core to the center of the core. More specifically, the core 30 illustrated in FIG. 2 is contoured in longitudinal cross-section to have a crown, generally represented by the reference numeral 31, in the center and a decreasing diameter moving toward the ends.

Mathematically, the contour of the core 30 is approximated by a beam deflection curve for a simply supported, uniformly loaded, constant cross-section beam. The preferred contour for the illustrated core 30 is approximated by a curve defining the diameter D ofthe core as: $D=1.721466+(-0.008524)X+(0.0065)X^2+(-0.002276)X^3+(0.000223)X^4$, where X is the absolute distance from the center of the core. Advantageously, this contour offsets the deflection of the roller 20 under load by creating a higher nip pressure at the center of the roller. Consequently, when the respective ends of the core 30 are loaded in a direction normal to the longitudinal axes of the core and the drum 14, this contour assists in producing the desired load profile along the full length of the nip 24. The desired load profile is determined empirically by optimizing performance with respect to media wrinkling and image uniformity across the page. In the present preferred embodiment, the optimum pressure profile is near uniform, with only an approximately 10% increase in pressure in the center of the roller as compared to the ends.

Surrounding the core 30 are three elastomeric layers: an inner elastomeric layer 32, a tubular elastomeric sleeve 36 and an outer compliant elastomeric layer 40. As described in more detail below, each of the three layers is preferably comprised of urethane for improved layer-to-layer bonding and greater fatigue resistance as compared to layers of dissimilar materials. As shown in FIG. 2, the inner elastomeric layer 32 is contoured to follow the contour of the core 30, with the thickness of the layer increasing from the center of the roller 20 toward each end. In this manner, the inner elastomeric layer 32 cooperates with the contoured core 30 to provide the desired pressure distribution by transferring the load balancing effect of the core to the nip 24. The inner elastomeric layer 32 also helps to offset other system imbalances, such as imbalanced end loads, varying ink image and media thicknesses and different part tolerances. Preferably, the inner elastomeric layer 32 is made from castable urethane with a durometer of between about 39 and about 49 Shore A, with the most preferred material having a durometer of 44 Shore A. A suitable urethane, identified as M44AXXTK, is available from the Mearthane Products Corporation of Cranston, R.I.

Affixed to an outer surface of the inner elastomeric layer 32 is a tubular elastomeric sleeve 36. In an important aspect of the present invention, the elastomeric sleeve 36 has a relatively high hardness or durometer to create a very narrow nip 24 (see FIG. 1) and a high localized pressure within the nip. In the preferred embodiment, the elastomeric sleeve 36 is made from castable urethane having a durometer of about 70 to about 85 Shore D, with the most preferred durometer being 80 Shore D. A suitable urethane, identified as M8ODXXTK, is available from Mearthane Products Corporation. Additionally, by utilizing urethane for both the inner elastomeric layer 32 and the elastomeric sleeve 36, a strong chemical bond is created between these components for superior durability as compared to an adhesive bond between dissimilar materials.

In another important aspect of the present invention, the preferred elastomeric sleeve 36, inner elastomeric layer 32 and contoured core 30 cooperate to create a very narrow nip, with the average nip width being between about 0.065 and about 0.075 inches (between about 1.651 mm and about 1.905 mm). Advantageously, this narrow nip concentrates the pressure created by the roller 20 within a localized area on the final receiving medium 22. In the preferred embodiment, this localization of pressure allows the roller 20 to create an average nip pressure of over about 1100 psi (7,584 kPa), and preferably a pressure of about 1150 psi (7,929 kPa). Additionally, this pressure is achieved with each end of the roller being loaded with less than about 600 pounds (lbs)(2,669 N.) per end, and preferably only approximately 550 lbs (2,446 N.) per end. In many prior art pressure rollers, a loading of between 400 and 600 lbs (1,779 and 2,669 N.) per end is necessary to create an average nip pressure of between 500 and 700 psi (3,447 and 4,826 kPa). Advantageously, the roller 20 of the present invention achieves significantly higher nip pressures with generally equivalent end loadings. Accordingly, the roller 20 may be incorporated into standard printing apparatus that are designed to accommodate roller loadings of up to 600 lbs (2,669 N.) per end.

As described above, the high nip pressure generated by the roller 20 of the present invention also allows for reduced medium and ink preheat temperatures as compared to prior art printing apparatus that generate much lower nip pressures. This is possible because the increased nip pressure provides added mechanical energy to compensate for the reduced thermal energy (ink/media temperatures). This added energy is necessary for adequate image durability and transfer from the intermediate surface. Advantageously, the lower ink and media temperatures allow the printer to duplex without smearing the duplexed image or wrinkling the medium. These lower temperatures also reduce the thermal energy requirements of the printing apparatus 10, making it more energy efficient.

As shown in FIGS. 2 and 3, the preferred embodiment of the elastomeric sleeve 36 includes a shoulder 38 near each end of the roller 20. The distance between the shoulders 38 corresponds to the largest imaging area, or the widest medium, that will be utilized with the printing apparatus 10. In one possible embodiment, the distance between the shoulders 38, and thus the widest possible imaging area, is about 13.6 inches (0.345 m.) and the overall length of the roller 20 is about 15.9 inches (0.404 m.). In this embodiment, the thickness of the sleeve 36 within the imaging area is approximately 0.100 inches (2.54 mm.). Advantageously, by incorporating the shoulders 38 at the edges of the widest possible medium to be used, the nip pressure is applied only to that portion of the roller 20 that engages the medium. This further reduces the end load requirements of the roller 20.

Figure 4:
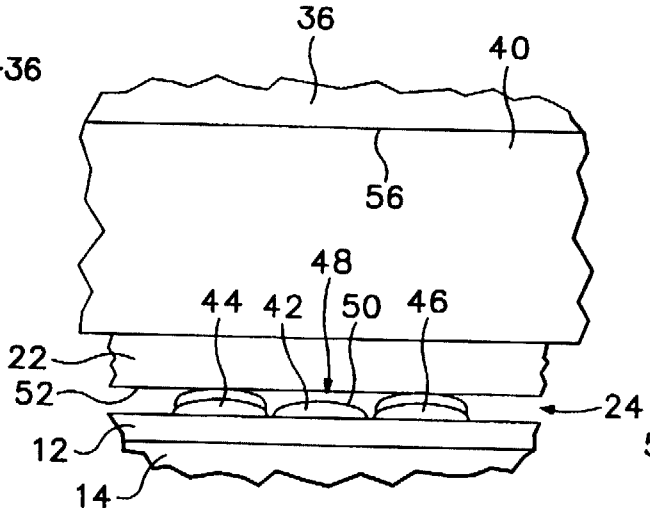
FIG. 4 is a schematic pictorial diagram showing a single layer ink pixel positioned between two dual layer ink pixels, and showing the final receiving medium contacting the top surface of the dual layer pixels.

As described above, in prior art pressure rollers the desired nip pressures are typically achieved by utilizing a very rigid, high durometer outer layer on the roller. However, while a rigid outer layer increases the nip pressure, it also reduces the ability of the roller to conform to variations in media and ink image thickness. For example, where a single ink pixel having a first height is adjacent to one or more multiple layer ink pixels having a second greater height, a roller with a rigid outer layer is often unable to conform to contact the shorter single ink pixel. As illustrated in FIG. 4 of the present application, this problem is especially apparent where a single ink pixel 42 is "hidden" between two adjacent dual layer pixels 44, 46, in which case an insufficiently compliant roller cannot conform to reach the single "hidden" pixel. As a result, image transfer (in offset printing) and image fusing to the medium are reduced, and other parameters of the imaging process must be adjusted to maintain an acceptable image quality. Typically in these situations, the media preheat and ink temperatures are increased to improve image transfer and fusing.

Figure 5:
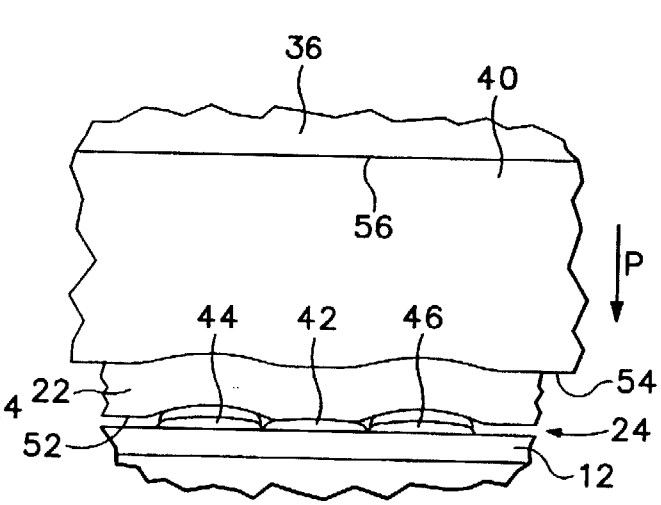
FIG. 5 is a schematic pictorial diagram showing an outer surface of the outer compliant elastomeric layer conforming to press the final receiving medium into contact with the single ink pixel, and showing an inner surface of the outer compliant elastomeric layer remaining substantially rigid to transmit maximum pressure to the medium.

To address and substantially overcome these problems of the prior art pressure rollers, the roller 20 of the present invention includes a thin outer compliant elastomeric layer 40 that is affixed to the elastomeric sleeve 36. FIGS. 4 and 5 illustrate the manner in which the outer compliant layer 40 of the roller 20 exhibits compliance across a two pixel span to improve the transfixing of ink pixels from an intermediate transfer surface to a final receiving medium.

With reference now to FIG. 4, the single ink pixel 42 is positioned between adjacent dual layer ink pixels 44, 46. Each of the pixels 42, 44, 46 is resting on the intermediate transfer surface 12. At this point in the transfix process, the two dual layer pixels 44, 46 are initially contacting an ink image receiving surface 52 of the final receiving medium 22 within the nip 24 before full nip pressure has been established. As shown in FIG. 4, a gap 48 exists between the top surface 50 of the single ink pixel 42 and the ink image receiving surface 52 of the final receiving medium 22.

With reference now to FIG. 5, the ability of the outer compliant layer 40 to conform within the diameter of the single ink pixel 42 is illustrated as the full nip pressure P is applied in the direction of action arrow P. More specifically, an outer surface 54 of the outer compliant layer 40 conforms to press the ink image receiving surface 52 downwardly to close the gap 48 of FIG. 4 and contact the "hidden" single ink pixel 42. Advantageously, in the preferred embodiment this improved compliance allows the roller 20 to transfix 100 percent of the ink pixels forming an ink image from the intermediate transfer surface 12 to the final receiving medium 22. In this manner, the outer compliant layer 40 advantageously provides a significant improvement in image transfer and overall image transfixing as compared to the rollers of the prior art. Furthermore, as shown in FIG. 5, an inner surface 56 of the outer compliant layer 40 remains substantially rigid when under full loading. In this manner, the full nip pressure P is transmitted on a macro level along the entire nip 24 through the outer compliant layer 40 to the final receiving medium 22 for optimal image fusing. Alternatively expressed, and to summarize an important aspect of the present invention, the outer compliant layer 40 cooperates with the rigid elastomeric sleeve 36, inner elastomeric layer 32 and core 30 to a create a high nip pressure on a macro level along the entire nip 24 while simultaneously exhibiting compliance on a micro/pixel-to-pixel level for optimal image transfer and fusing.

To achieve the above performance characteristics, the preferred material for the outer compliant elastomeric layer 40 is castable urethane having a durometer of between approximately 80 and approximately 90 Shore A, with the most preferred durometer being approximately 85 Shore A. A suitable urethane, identified as M85AXXTK, is available from Mearthane Products Corporation. The preferred thickness of the outer compliant elastomeric layer 40 is between approximately 0.010 and approximately 0.020 inches, with the most preferred thickness being 0.015 inches. The preferred hardness and thickness allow the outer compliant elastomeric layer 40 to deflect at least 0.001 inches under a load of approximately 1150 psi to contact a single layer ink pixel hidden between adjacent dual layer pixels. Additionally, the outer surface 54 of the outer compliant elastomeric layer 40 preferably has a surface finish of approximately $16\times10^{-6}$ inches ($4\times10^{-4}$ mm.) or better to maintain uniform pressure over porous media surfaces. The preferred urethane construction of the outer compliant layer 40 also provides a superior chemical bond with the adjacent urethane sleeve 36 to withstand the shear stresses and other forces created by the high nip pressure of the roller 20.

In summary, the pressure roller 20 of the present invention combines rigidity for high nip pressure with compliance for superior image transfer and fusing and improved nip pressure uniformity. These benefits of the roller are achieved with lower media and ink temperatures that allow for duplex printing and reduce media wrinkling. The roller also utilizes three urethane layers for improved layer-to-layer bonding and greater fatigue resistance.

The foregoing description of a preferred embodiment of the invention has been presented for purposes of illustration and description. It is not intended to be exhaustive or to limit the invention to the precise form disclosed. Many changes, modifications, and variations in the materials and arrangement of parts can be made, and the invention may be utilized with various different printing apparatus, all without departing from the inventive concepts disclosed herein. The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally, and equitably entitled. All patents cited herein are incorporated by reference in their entirety.

What is claimed is:

1. A roller for applying pressure to a final receiving medium to fix an ink image formed by ink pixels thereon, the roller comprising:

a tubular elastomeric sleeve having a first hardness of between about 70 and about 85 Shore D;

a core positioned within and spaced from the tubular elastomeric sleeve;

an inner elastomeric layer interposed between the core and the tubular elastomeric sleeve; and an outer compliant elastomeric layer affixed to the tubular elastomeric sleeve, the outer compliant elastomeric layer having a second hardness that is less than the first hardness of the tubular elastomeric sleeve, the outer compliant elastomeric layer being sufficiently compliant to contact ink pixels having at least first and second heights so as to fix the ink pixels to the final receiving medium, whereby the ink image is effectively fused to the final receiving medium to achieve maximum image quality while minimizing wrinkling or other degradation of the ink image on the final receiving medium.

2. The roller for applying pressure to a final receiving medium to fix an ink image thereon of claim 1, wherein the roller is biased toward a supporting surface to form a nip therebetween, the nip having a nip pressure of at least 1100 psi.

3. The roller for applying pressure to a final receiving medium to fix an ink image thereon of claim 2, wherein the outer compliant elastomeric layer is compressed by at least 0.001 inches within the nip.

4. The roller for applying pressure to a final receiving medium to fix an ink image thereon of claim 2, wherein the nip is created by applying a load of less than 600 lbs to each end of the roller or the supporting surface.

5. The roller for applying pressure to a final receiving medium to fix an ink image thereon of claim 4, wherein the nip has an average width of between about 0.065 and about 0.075 inches.

6. The roller for applying pressure to a final receiving medium to fix an ink image thereon of claim 1, wherein the outer compliant elastomeric layer has a hardness of between about 80 and about 90 Shore A.

7. The roller for applying pressure to a final receiving medium to fix an ink image thereon of claim 6, wherein the outer compliant elastomeric layer has a thickness of between about 0.010 and about 0.020 inches.

8. The roller for applying pressure to a final receiving medium to fix an ink image thereon of claim 1, wherein the inner elastomeric layer has a hardness of between about 39 and about 49 Shore A.

9. The roller for applying pressure to a final receiving medium to fix an ink image thereon of claim 1, wherein the tubular elastomeric sleeve, the inner elastomeric layer and the outer compliant elastomeric layer are each composed of urethane.

10. The roller for applying pressure to a final receiving medium to fix an ink image thereon of claim 1, wherein the outer compliant elastomeric layer is sufficiently compliant to fix 100% of the ink pixels forming the ink image to the final receiving medium.

11. The roller for applying pressure to a final receiving medium to fix an ink image thereon of claim 1, wherein the core is cylindrical.

12. An apparatus for applying pressure to a final receiving medium to transfer an ink image formed by ink pixels from an intermediate transfer surface to the final receiving medium and to fix the ink image on the final receiving medium, the apparatus comprising:

a supporting surface supporting the intermediate transfer surface;

a roller biased toward the supporting surface to form a nip therebetween, the roller comprising a tubular elastomeric sleeve having a first hardness of between about 70 and about 85 Shore D, a core positioned within and spaced from the tubular elastomeric sleeve, an inner elastomeric layer interposed between the core and the tubular elastomeric sleeve, and an outer compliant elastomeric layer affixed to the tubular elastomeric sleeve, the outer compliant elastomeric layer having a second hardness that is less than the first hardness of the tubular elastomeric sleeve, the outer compliant elastomeric layer being sufficiently compliant to cause the final receiving medium to contact ink pixels having at least first and second heights so as to transfer and fix the ink pixels to the final receiving medium; and a biaser urging the supporting surface and the roller together to impart a nip pressure to the ink image on the final receiving medium as the final receiving medium passes through the nip, whereby the ink image is effectively transferred and fixed to the final receiving medium with maximum image quality while minimizing wrinkling or other degradation of the ink image on the final receiving medium.

13. The apparatus for applying pressure to a final receiving medium to transfer an ink image from an intermediate transfer surface to the final receiving medium and to fix the ink image on the final receiving medium of claim 12, wherein the nip formed by the roller and the supporting surface has an average nip pressure of at least 1100 psi.

14. The apparatus for applying pressure to a final receiving medium to transfer an ink image from an intermediate transfer surface to the final receiving medium and to fix the ink image on the final receiving medium of claim 12, wherein the outer compliant elastomeric layer is compressed by at least 0.001 inch within the nip.

15. The apparatus for applying pressure to a final receiving medium to transfer an ink image from an intermediate transfer surface to the final receiving medium and to fix the ink image on the final receiving medium of claim 13, wherein the nip is created by applying a load of less than 600 lbs to each end of the roller or the supporting surface.

16. The apparatus for applying pressure to a final receiving medium to transfer an ink image from an intermediate transfer surface to the final receiving medium and to fix the ink image on the final receiving medium of claim 12, wherein the nip has an average width of between about 0.065 and about 0.075 inches.

17. The apparatus for applying pressure to a final receiving medium to transfer an ink image from an intermediate transfer surface to the final receiving medium and to fix the ink image on the final receiving medium of claim 12, wherein the outer compliant elastomeric layer has a hardness of between about 80 and about 90 Shore A.

18. The apparatus for applying pressure to a final receiving medium to transfer an ink image from an intermediate transfer surface to the final receiving medium and to fix the ink image on the final receiving medium of claim 17, wherein the outer compliant elastomeric layer has a thickness of between about 0.010 and about 0.020 inches.

19. The apparatus for applying pressure to a final receiving medium to transfer an ink image from an intermediate transfer surface to the final receiving medium and to fix the ink image on the final receiving medium of claim 12, wherein the inner elastomeric layer has a hardness of between about 39 and about 49 Shore A.

20. The apparatus for applying pressure to a final receiving medium to transfer an ink image from an intermediate transfer surface to the final receiving medium and to fix the ink image on the final receiving medium of claim 12, wherein the tubular elastomeric sleeve, the inner elastomeric layer and the outer compliant elastomeric layer are each composed of urethane.

21. The apparatus for applying pressure to a final receiving medium to transfer an ink image from an intermediate transfer surface to the final receiving medium and to fix the ink image on the final receiving medium of claim 12, wherein the outer compliant elastomeric layer is sufficiently compliant to transfix 100% of the ink pixels forming the ink image to the final receiving medium.

22. The apparatus for applying pressure to a final receiving medium to transfer an ink image from an intermediate transfer surface to the final receiving medium and to fix the ink image on the final receiving medium of claim 12, wherein the core is cylindrical.

23. The roller for applying pressure to a final receiving medium to fix an ink image thereon of claim 1, wherein the tubular elastomeric sleeve has a thickness of approximately 0.100 inches.

24. The apparatus for applying pressure to a final receiving medium to transfer an ink image formed by ink pixels from an intermediate transfer surface to the final receiving medium and to fix the ink image on the final receiving medium of claim 12, wherein the tubular elastomeric sleeve has a thickness of approximately 0.100 inches.

* * * * *